United States Patent [19]

Cruz

[11] 4,299,006

[45] Nov. 10, 1981

[54] ELASTIC DRIP GUARD FOR PAINT BRUSHES

[76] Inventor: Miguel M. Cruz, 112 SW. 96th Ave., Miami, Fla. 33174

[21] Appl. No.: 122,269

[22] Filed: Feb. 19, 1980

[51] Int. Cl.[3] ..... A46B 17/00

[52] U.S. Cl. ..... 15/248 R

[58] Field of Search ..... 15/248, 168

[56] References Cited

U.S. PATENT DOCUMENTS

| | | | |
|---|---|---|---|
| 134,302 | 12/1872 | Miller | 15/248 R X |
| 1,864,059 | 6/1932 | Frenkel | 15/248 R |
| 1,887,525 | 11/1932 | Spiegelhalter | 15/248 R |
| 2,892,205 | 6/1959 | Wagner | 15/248 R |
| 3,061,864 | 11/1962 | Miller | 15/248 R |
| 3,214,778 | 11/1965 | Mathison | 15/248 R X |

FOREIGN PATENT DOCUMENTS

| | | | |
|---|---|---|---|
| 417507 | 10/1934 | United Kingdom | 15/248 R |

*Primary Examiner*—Chris K. Moore

*Attorney, Agent, or Firm*—Jesus Sanchelima

[57] ABSTRACT

A loop of elastic material adapted for removable placement about the handle body portion of the paint brush at the base of the bristles is U-shaped in cross section to define an outwardly open trough for catching excess paint which might otherwise flow down or drip from the brush handle. The elastic loop is provided, at opposed end portions where passing around the arcuate end portions of the brush body, with interior spacer strips maintaining mutual parallel spacing of the opposed legs or sidewalls of the elastic loop which define the trough.

1 Claim, 6 Drawing Figures

ELASTIC DRIP GUARD FOR PAINT BRUSHES

BACKGROUND OF THE INVENTION

1. Field of Invention

This invention relates to ordinary paint brushes and is directed particularly to a novel and improved removable drip guard for such paint brushes.

2. Description of Prior Art

Because of the tendency of paint, varnish or the like painting materials to flow down or along and drip from the body of the brush handle, particularly when a brush is being used for overhead painting, various devices to prevent such dripping have heretofore been proposed. U.S. Pat. No. 2,167,523 to Reichenback, for example, describes a fountain brush the bristles of which are surrounded at their base with a rigid metal, peripheral drip catcher defining an annular collecting space within which excess paint can collect. A resilient gasket of packing material is clamped between the drip catcher and the handle base to prevent leakage. U.S. Pat. No. 2,426,531 to Stevason describes a brush-like wall cleaner having a tubular handle along which a substantially rigid dished vessel is coaxially secured for catching drippings from the brush head. U.S. Pat. No. 2,581,141 to Raptis illustrates and describes a complicated adjustable paint brush and brush handle wherein a cylindrical reservoir at the base of the brush serves to collect excess paint passing through interior openings in the bristle supporting structure. U.S. Pat. No. 2,803,031 to Cervelli describes a sponge rubber hair treating solution applicator at the end of a handle, and a substantially rigid cup fixed in surrounding relation between the applicator sponge of the handle, serving to catch drippings and thereby prevent the liquid being applied from running down the handle.

SUMMARY OF THE INVENTION

It is the principal object of this invention to provide a drip guard for ordinary paint brushes that obviates the complexities of drip guards heretofore devised.

A more particular object of the invention is to provide a drip guard of the above nature that is in the form of an elastic loop, whereby it is not only easily removable for cleaning, but is adaptable for use with brushes of various sizes and shapes in closely embracing relation with respect to the peripheral outer wall of the brush body, thereby also obviating any need of packing to prevent leakage between the drip guard and brush handle body.

Still another object of this invention is to provide an elastic drip guard for paint brushes that will withstand being dropped to the floor or accidentally hit against different parts of a structure by the painter, without deforming or breaking said drip guard.

Another object of the invention is to provide a novel and improved drip guard for paint brushes which, being comprised of extremely simple and inexpensive parts, can be marketed as a disposable item.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

DESCRIPTION OF THE PREFERRED EMBODIMENT

Figure 1:
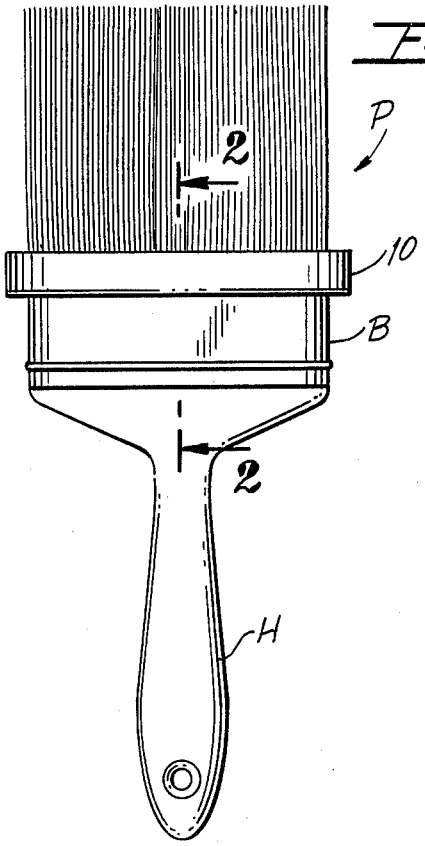
FIG. 1 is a side elevational view of an ordinary paint brush showing a removable drip guard embodying the invention assembled thereto.
Figure 2:
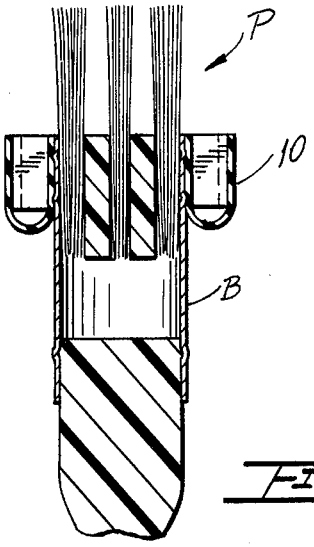
FIG. 2 is a partial elevational view of the paint brush assembly illustrated in FIG. 1, as viewed on an enlarged scale from one end of the brush body and with a portion of the drip guard cut away to reveal constructional details.
Figure 4:
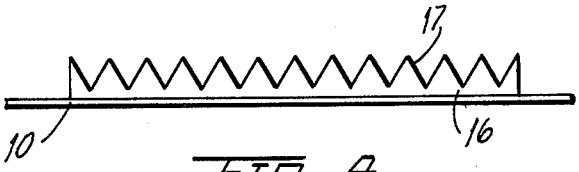
FIG. 4 is a longitudinal edge view of one of the spacer strips comprising the drip guard.

Referring now in detail to the drawings, reference numeral 10 in FIGS. 1 and 2 designates, generally, a preferred form of elastic drip guard embodying the invention applied for use on an ordinary paint brush P. As is hereinafter more particularly described, the elastic drip guard 10, being stretchable, embracingly fitted about the body portion B of the handle H of a paint brush, with its open end at the base of the brush bristles so as to catch and contain excess paint while painting, and thereby obviate dripping.

The drip guard 10 will preferably be integrally formed of a highly resilient or elastic material, such as rubber or neoprene, and is of elongated loop shape, similar to that of a rubber band. As such, in use it will define a pair of opposed, substantially straight, parallel side run portions 11, 12 merging at their respective ends with opposed arcuate portions 13, 14. As illustrated in FIG. 2, the drip guard 10 is U-shaped in cross-section as defined by a continuous U-shaped band portion open at its upper end, i.e., the end directed towards the outer ends of the bristles when applied for use to an ordinary paint brush, thereby to present a trough or reservoir for capturing excess paint which otherwise flows down and drips from the brush handle.

In order to preserve the open trough shape of the drip guard at the rounded ends of a paint brush handle body portion B upon application thereto for use, the arcuate portions 13, 14 are provided with a pair of opposed, flexible spacer portions 16, which are transversely fluted or grooved along their lengths, as indicated at 17, to provide for through passage of paint, varnish or the like. It is to be noted that the base of the spacer portions 16 may be integrally formed with the inside of the outer web of the U-shaped drip guard band with the apices defined by the grooves being directed inwardly for abutment against inner surface portions of the opposite inner wall of the elastic band so that when the drip guard is removed, the spacer grooves are fully exposed for cleaning.

Figure 3:
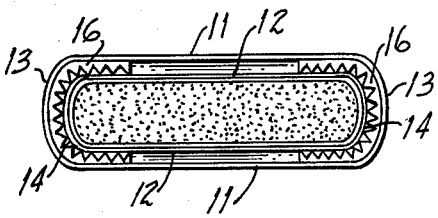
FIG. 3 is a top plan view of the brush and drip guard assemblage shown in FIG. 1.
Figure 5:
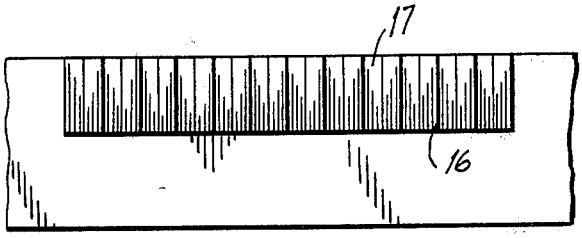
FIG. 5 is an inside view of a drip guard spacer shown in FIG. 4.
Figure 6:
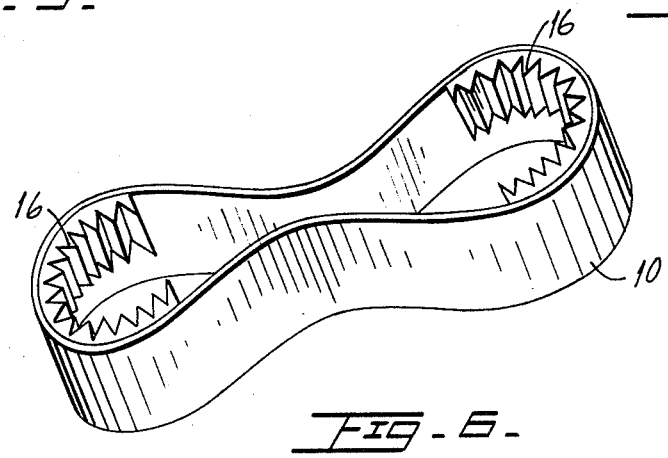
FIG. 6 is a perspective view of the elastic band comprising the drip guard.

In use, the drip guard 10 can readily be stretched to fit in embracing relation about the body portion B of a paint brush P by passing it over the handle H. Placement is such that the spacers 16 fit snugly around the rounded ends of the paint brush body, thereby to prevent collapse of the trough defined by the elastic band portions 13, 14. Thus, as illustrated in FIG. 3, the band side walls are kept open not only along the arcuate end portions 13, 14, but also along the side run portions 11, 12. The drip guard 10 will thus be in position and operative to catch and retain in its reservoir excess paint flowing backwardly along the brush bristles towards the base B. Because of its elasticity, the drip guard 10 fits snugly against the outer periphery of the paint brush at its base, thereby obviating the possibility of paint leakage between the paint brush body and the inside of the drip guard.

It will be understood that the elastic drip guard 10 is particularly useful during overhead painting, wherein excess paint will have a tendency to flow by gravity towards the brush handle. Excess paint thus captured can be retrieved for use simply by inverting the brush from time to time, during brush wetting operations, so that it flows back towards the tip end of the brush bristles for application to the surface being painted.

It is to be understood that the invention also contemplates separate fabrication of the elastic band and spacer portions of the drip guard assemblage, to be interfittingly assembled upon application of the device to a paint brush for use as described above. In such an embodiment of the invention, the band portion will normally be flat, as in a wide rubber band, so as to be inwardly foldable along its length to provide the U-shape trough into which separate spacers 16 would be appropriately inserted.

While I have illustrated and described herein only two forms in which my invention can conveniently be embodied in practice, it is to be understood that these forms are presented by way of example only and not in a limiting sense. My invention, in brief, comprises all the embodiments and modifications coming within the scope and spirit of the following claims.

What is claimed is:

1. An elastic drip guard for paint brushes comprising, in combination, a flat loop of elastic material, said loop being transversely foldable along its length to provide a trough extending in the axial direction of said loop, and a pair of spacer members receivable in said loop trough, said loop being of such peripheral size as to stretchingly fit in embracing relation about the body portion of a paint brush at the base of the bristles thereof with the trough opening extended outwardly towards the ends of the bristles, the spacer members of the elastic loop being adapted for placement at opposite ends around the brush body portion to prevent collapse of the walls of said U-shape elastic member defining said trough.

* * * * *